United States Patent [19]

Kranz et al.

[11] 4,096,038

[45] Jun. 20, 1978

[54] METHOD AND APPARATUS FOR OPERATING A CALCINER UNDER A PRESSURE DIFFERENTIAL

[75] Inventors: Ray E. Kranz; William E. Solano; Beverly E. Johnson, all of Pittsburgh, Pa.

[73] Assignee: Salem Furnace Co., Carnegie, Pa.

[21] Appl. No.: 728,643

[22] Filed: Oct. 1, 1976

[51] Int. Cl.[2] ..... C10B 21/18; C10B 47/30

[52] U.S. Cl. ..... 201/32; 201/1; 202/110; 202/136; 202/103; 202/216; 236/15 BE; 236/15 C; 266/89; 266/87; 432/47; 432/139; 432/117; 110/163; 110/147

[58] Field of Search ..... 201/32, 1; 202/110, 202/136, 100, 103, 216, 218; 266/89, 87; 236/15 BF, 15 C; 432/47, 139, 117; 110/163, 147; 126/285

[56] References Cited

U.S. PATENT DOCUMENTS

| | | | |
|---|---|---|---|
| 1,840,723 | 1/1932 | King | 432/48 X |
| 2,169,150 | 8/1939 | Johnson | 236/15 C |
| 2,625,386 | 1/1953 | Leone | 236/15 BF |
| 3,594,287 | 7/1971 | Allred | 202/216 X |
| 3,730,849 | 5/1973 | Allred | 202/218 X |

*Primary Examiner*—James H. Tayman, Jr.
*Attorney, Agent, or Firm*—Frank P. Cyr

[57] ABSTRACT

Method and apparatus for the heat treatment of volatile containing materials in a rotary hearth type furnace wherein the flue gases emanating from the calciner are employed to create either a positive or negative pressure within the calciner hearth as well as the soaking pit area of the said calciner.

8 Claims, 4 Drawing Figures

METHOD AND APPARATUS FOR OPERATING A CALCINER UNDER A PRESSURE DIFFERENTIAL

BACKGROUND OF THE INVENTION

Rotary hearth calciners are well known in the art and have been employed with considerable success for the processing of carbonaecous materials therein with a considerable savings in the amount of fuel required to process the said materials. Such calciners have been employed in the treatment of volatile containing substances such as, for example, non-caking coal, anthracite coal, wood products, green petroleum coke, pellets or briquettes containing controlled percentages of bituminous caking coal and other carbonaceous materials or inerts either with or without a bituminous binder. Such calciners have also been employed in the calcining of dolomite, limestone, and cement rock, the reclaiming of calcium oxide from carbonate sludge, the decomposition of carbonates, sulphates and chlorides, the reactivation of activated carbon, and/or the like. Also, such calciners have been employed in the simultaneous production of metallized ores and coke from oxide pellets or other feeds rich in metal oxides which are charged into the calciner along with a carbonaceous material, such as coal or the like.

The known calciners comprise a substantially airtight enclosure having a roof, sidewalls and an imperforate rotating or traveling hearth upon which the materials to be processed are deposited. The materials to be processed contain volatiles which evolve therefrom when exposed to heat. At the start of a calcining operation for the production of coke, or for the simultaneous production of metallized ores and coke, the furnace enclosure is brought to operating temperatures, that is, the temperature within the furnace is such that some of the volatiles in the carbonaceous materials which have been deposited on the hearth are evolved therefrom and caused to travel upwards within the furnace to a position closely adjacent the roof thereof where air and/or an air-oxygen mixture is admitted into the furnace and to there comingle with the evolved volatiles to produce an oxidizing atmosphere in that portion of the furnace while maintaining a reducing atmosphere about the materials undergoing treatment on the hearth. The burning of the volatiles in that portion of the furnace will heat the roof and sidewalls thereof so that the heat radiated from the roof and sidewalls and also from the oxidizing volatiles in the upper portion of the furnace will result in a continued removal of volatiles from the materials undergoing treatment on the hearth. The continued removal of volatiles from the materials undergoing treatment, as aforesaid, and the continued supply of air to the upper portion of the furnace may, in some instances, supply all of the heat to properly process the materials undergoing treatment on the hearth and to permit for the continued operation of the furnace on a autogenetic basis, whether the calciner is employed to produce a coke from a carbonaceous volatile containing material such as set forth previously or whether the calciner is employed to simultaneously produce a metallized ore and coke from a combined charge of metal oxide pellets, or the like, and a carbonaceous material. In instances where the carbonaceous materials do not release sufficient volatiles to permit for the continued operation of the calciner on an autogenetic basis, outside heat may be supplied in any suitable manner, for example in the upper portion of the enclosure by burners mounted either in the roof or sidewalls of the enclosure to thereby insure the proper processing of the materials which have been deposited on the hearth.

The aforesaid known calciners are designed to operate on a continuous basis with materials being continuously introduced onto the hearth and following the processing thereof, the materials are then directed to a suitable outlet. In the case of a rotating hearth having a central outlet for the processed materials, roof mounted rabbles may be employed for progressively advancing the materials to the central outlet. In instances where such rabbles are not used, suitable scraper means may be employed to extend over the traveling hearth to direct the processed materials outwardly of the hearth to a suitable receiver means located in close proximity to the calciner.

Previously known calciner structures have not been concerned with a problem which has resulted in a poorer yield of processed materials than that attained by employing the method and apparatus set forth with particularity in the ensuing description of the invention.

SUMMARY OF THE INVENTION

The main object of the present invention is to provide a calciner structure with a means whereby the interior of a calciner may be maintained under a pressure above or below that of the surrounding atmosphere.

Another object of the invention is to utilize an adjustable damper in the flue of the calciner whereby the flow of outgoing gases in the flue may be regulated to cause a back-up of the flue gases within the calciner with resultant increase in pressure within the confines of the calciner.

Another object of the invention is to provide a structure wherein some of the flue gases in the stack of the calciner may be diverted and directed to the soaking pit area of the calciner to thus increase the pressure in that portion of the calciner to preclude the entry of air thereinto with resultant increase in the yield of fixed carbon in the already processed carbonaceous materials.

Another object of the invention is to provide a calciner with a means in the flue stack to regulate the amount of gases escaping in the flue and to divert some of the flue gases to the soaking pit area of the calciner to preclude the entry of air at that portion of the calciner with resultant increase in yield in the percentage of metallization when the calciner is employed for the simultaneous production of metallized ores and coke.

Another object of the invention is to provide a means whereby the pressure within the calciner enclosure as well as the pressure within the soaking pit area of the calciner may be readily determined and the damper flue adjusted to create a pressure within these portions of the calciner at above or below atmospheric pressure.

The above and other objects and advantages of the invention will appear more clearly from the following specification and the accompanying drawings.

Figure 1:
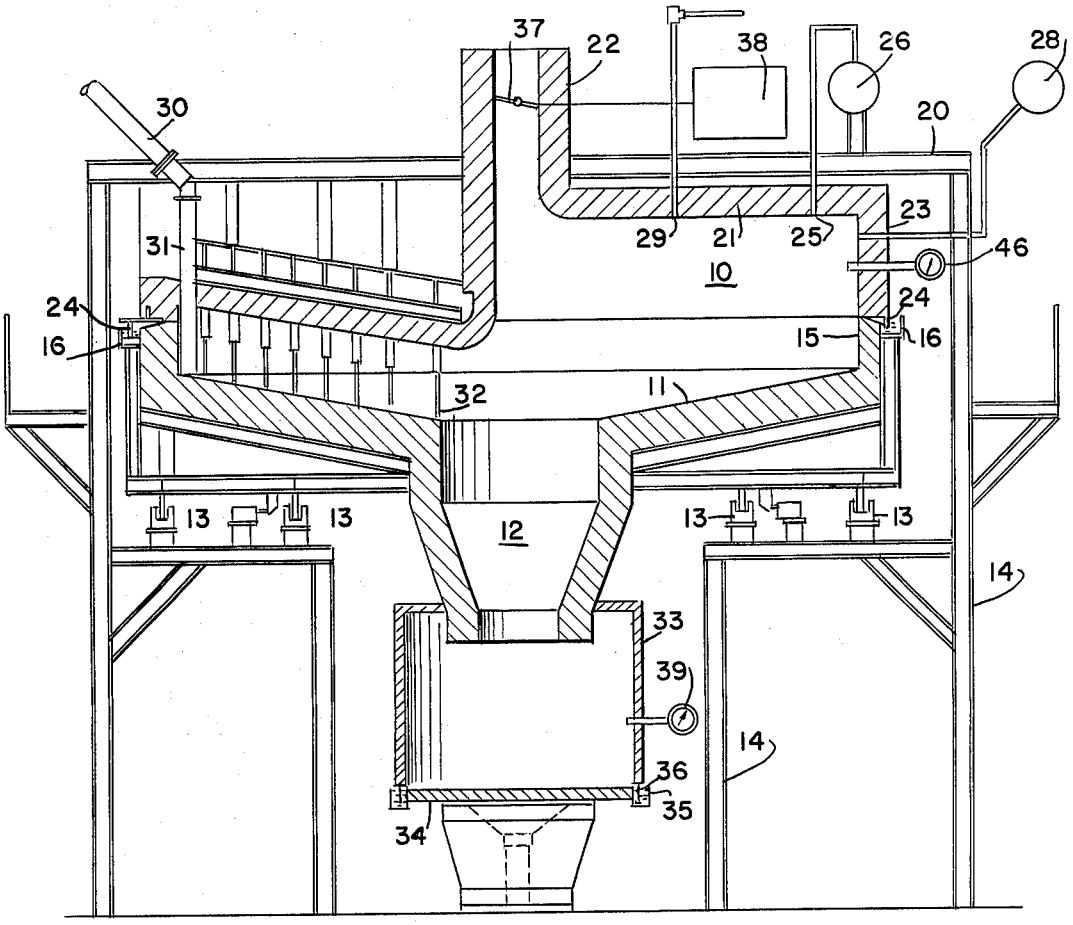
FIG. 1 is a vertical section through a furnace or calciner embodying our invention.

However, it is to be understood that the specific drawing illustrations provided are supplied primarily to comply with the requirements of the Patent Law, and the invention has other embodiments which will be obvious to those skilled in the art, and which are intended to be covered by the appended claims.

GENERAL DESCRIPTION

Throughout the ensuing description, like reference numerals will be employed to designate like parts throughout the several views in the drawings.

Referring now to the drawings reference numeral 10 designates generally a furnace enclosure or calciner shown in prior U.S. Pat. issued to Kemmerer and Buschow, Nos. 3,470,068 and 3,475,286 which patents are incorporated herein by reference. The furnace 10 is provided with an inner hearth surface 11 slanting downwardly from the outer periphery of the furnace enclosure to a central axially extending concentrically arranged soaking pit area 12 formed integral with and depending from the hearth 11. The hearth 11 and soaking pit 12 are driven for rotation by a motor and drive in the conventional manner for rotary hearth furnaces.

The rotary hearth is supported on suitable rollers 13 mounted on a framework 14. While the hearth is shown as being slanted downwardly and having a centrally located soaking pit area, it is conceivable that such hearth could be in the nature of a flat horizontally extending surface with a soaking pit area arranged along the periphery of the furnace or be centrally located as shown in the aforesaid patents. A curb 15 extends vertically above the hearth surface 11 at its outer periphery and has mounted thereon a trough 16 filled with sand or other suitable material.

Roof beams 20 support a refractory roof 21 usually having a central stack or flue 22. The roof 21 has a depending wall 23 carrying a flange 24 which extends into the sand or the like in trough 16 to form a seal between the stationary roof 21 and the rotary hearth 11 to prevent the entry of air into the furnace enclosure between these parts of the furnace structure. The roof is provided with air and/or air-oxygen mixture admission ports 25 extending from a manifold 26 mounted on the framework 20. The ports 25 direct air and/or an air-oxygen mixture downwardly towards the hearth 11. Sidewalls 23 of the roof 20 are provided with ports 27 receiving air and/or air-oxygen mixture from a manifold 28 supported in any known manner in the framework 14. The ports 27 direct air or an air-oxygen mixture generally across the hearth in a radial direction. Burners 29 are provided in the roof 21 to bring the furnace to proper operating temperature and also to provide additional heat for the reactions within the furnace when the materials undergoing treatment in the furnace do not release sufficient volatiles from therein to permit for the furnace to operate on an autogenetic basis such as fully described in the aforesaid Kemmerer and Buschow patents.

A feed chute (or chutes) 30 extends through the roof and is provided with a vertically adjustable delivery chute 31 extending to a position closely adjacent to the floor of the hearth to deliver thereon a selected thickness of feed of materials. While we have shown the admission chute as being located along the outer periphery of the hearth, such a chute could be located elsewhere along the furnace enclosure, the specific location of the feed chute being immaterial in carrying out the objects of the invention. Also, while we have shown the hearth as being a one-piece structure, the hearth may be sectional such as shown in U.S. Pat. No. 3,998,703, in the name of John B. Harrell. Rabbles 32 are suitably supported in the roof 21 and the rabbles are so arranged as to engage with the materials undergoing treatment on the hearth to stir the same and to simultaneously advance the same to the soaking pit 12 when the calciner is in operation.

Figure 2:
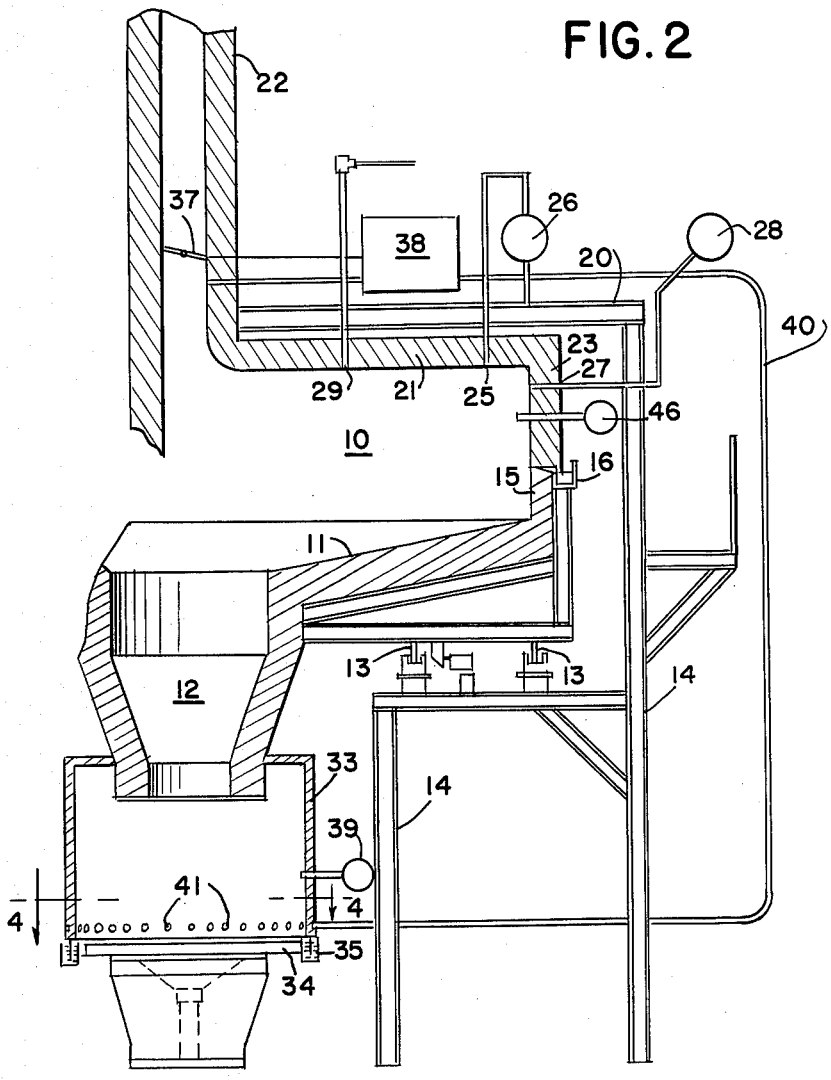
FIG. 2 is a vertical section, with parts broken away, of a modification of our invention.
Figure 4:
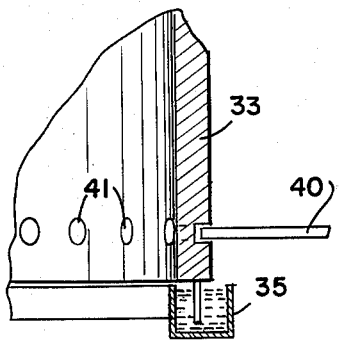

Operation of the structure shown in FIGS. 1 and 2 of the drawings is set forth with particularity in the aforesaid Kemmerer and Buschow patents. However, to summarize the method of operation of the structure shown in the aforesaid Kemmerer and Buschow patents, volatile containing materials such as coal, or the like, with or without a feed of metal oxides, depending on the end product to be derived from the heat process, is fed onto the hearth of the furnace. Previous to the feed of the said materials onto the hearth, the temperature within the calciner enclosure will have been brought to the desired degree heat by the roof mounted burners and the volatile containing materials will now release some of these volatiles which will mix with air and/or an air-oxygen mixture in the upper portion of the furnace or calciner to produce an oxidizing atmosphere in that portion of the enclosure while retaining a reducing atmosphere about the materials undergoing treatment on the hearth. During operation of the furnace or calciner as aforesaid, the rabbles will advance the materials towards an outlet or soaking pit area and from the soaking pit area the processed materials are deposited on a table or the like from which they are removed and directed to a suitable receiver means (not shown).

It should be pointed out, however, that the previously known calciner structures were concerned primarily with the condition within the hearth and for this purpose the calciner was so constructed as to preclude the admission of air within the hearth proper and no thought was given to the exclusion of air within the soaking pit area.

As stated in the objects of the invention, one of the main objects is to preclude the entry of air within the soaking pit area so as to increase the yield of carbon when a volatile containing material such as coal or the like is subjected to a heat treatment within the calciner or to increase the yield of metallized ores when a combined charge of metal oxide and a volatile containing material is fed on the hearth of the calciner for processing therein.

Referring now to FIG. 1 of the drawings, there is shown therein a shroud 33 formed of any suitable material. The shroud may be secured to the soaking pit area in any known manner provided there is formed an airtight seal between the shroud and the soaking pit 12. The shroud 33 extends over a discharge table 34 of conventional construction. A trough 35 extends around the outer perimeter of table 34 and a blade 36 is secured in any known manner to the lower edge of the shroud 33 and extends into the trough which may be filled with sand or the like to form a seal between the shroud and discharge table.

Figure 3:
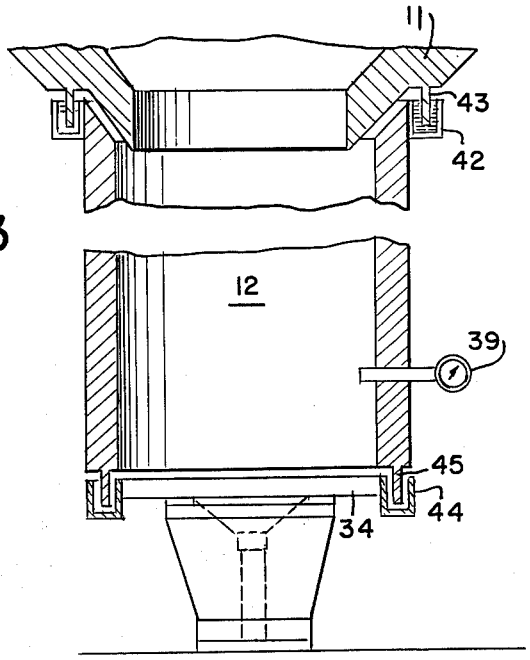
FIG. 3 is a vertical section, with parts broken away, of a modified form of a soaking pit arrangement, and, FIG. 4 is an enlarged vertical section, with parts broken away, taken on lines 4—4 of FIG. 2, looking in the direction of the arrows.

In instances where a stationary soaking pit is employed along with a rotary hearth, a seal is maintained between the rotary hearth and the stationary soaking pit. Such a seal is shown in FIG. 3 of the drawings and the same consists of a trough 42 mounted on the soaking pit with a blade 43 fixed in any manner to the rotating hearth 11. The blade 43 extends into the trough which may be filled with sand, water, coke or char or the like. A like trough 44 is mounrted along the periphery of the rotating discharge table 34 and a blade 45 mounted in any known manner on the lower end of the soaking pit extends within the trough which is filled with sand or the like. The blade 45 may extend completely around the lower end of the soaking pit area save for the area where the materials on the discharge table are removed from thereon and directed to a suitable receiver means, (not shown). A gauge 39 extends from within the soaking pit area to indicate the pressure maintained in this area of the calciner.

Combustion gases are employed for controlling the pressure condition within the hearth as well as in the soaking pit area of the calciner. A damper 37 is pivotally mounted in the flue or stack 22 and the same may be adjusted either manually or the adjustment made responsive to a pressure responsive device 38. As can be appreciated, restricting to some extent the outward flow of the combustion gases through the flue by adjustment of the pivoted damper therein will result in a build up of pressure within the calciner enclosure. In tests conducted employing a calciner constructed in accordance with the calciner shown in FIG. 1 of the drawings which includes a damper in the flue as well as a shroud about the discharge table, the furnace pressure was carried at about +3 to +4 mm W.C. at a point about 1 foot below the roof level of the calciner and since the distance between the roof of the calciner and the soaking pit area is relatively small, a pressure of about +1 to +2 mm W.C. was maintained at the bottom of the soaking pit area as well as at the bottom of the shroud area thus preventing the entry of air into these areas with resultant increase in the yield of fixed carbon as well as an increasse in the percentage of metallization of the ores. The increase in pressure within the calciner as well as in the soaking pit and shroud areas need not be great so long as the pressure within the confines of the shroud area and the soaking pit be above atmospheric pressure. The increase in pressure within the calciner areas as set forth above coupled with the seals formed between the stationary and rotating parts of the calciner will prevent the entry of air into these portions of the calciner, and, as stated above, the exclusion of air particularly at the soaking pit or shroud areas has resulted in a better yield of fixed carbon as well as a greater percentage of metallization of the ores in the end product.

A gauge 46 extending from within the furnace chamber, below the roof 21, will indicate the pressure within the hearth area of the furnace whereas the gauge 39 extending from within the soaking pit and/or shroud area will indicate the pressure within these areas.

During operation of the calciner, the operator thereof need only to refer to the pressure readings indicated by the aforesaid gauges 39 and 46 and adjust the position of the damper in the flue to restrict the exit of flue gases in the stack resulting in an increase of pressure in the calciner as well as in the soaking pit and/or shroud areas. The pressure responsive unit 38 may be made responsive to the pressures in readings of either gauges 39, 46 and automatically position the damper in the flue in the desired position to insure an increase in pressure in the calciner as well as in the soaking pit and/or shroud areas.

There are a number of ways in which the pressure within the calciner enclosure as well as in the soaking pit and/or shroud areas can be maintained at above atmospheric pressure with such increase in pressure obtained by utilizing the flue gases of the furnace. By way of example only, shown in FIG. 2 of the drawings, is one way in which the flue gases are utilized to provide for the increase in pressure in the soaking pit and/or shroud areas of the calciner. For instance, a conduit 40 extends from a point below the damper 37 in the flue 22 and leads to the lower portion of the shroud 33 which is fixed to and rotates with the soaking pit 12 which is formed integral with the rotating hearth. The pressure gauge 39 which extends from within the shroud area will indicate the amount of pressure therein and from this reading, the position of the damper in the flue can be adjusted to restrict the outward flow of gases in the flue with resultant exit of such gases into the conduit 40 where the same will be directed into the shroud area through openings 41 formed in the shroud 33 and ultimately into the soaking pit area 12.

By way of example only, and not set forth herein as restrictive, brown coal was tested in a rotary hearth calciner. Fixed carbon recoveries for 3 separate tests were reported as 47.5%, 77.5% and 81.5%. The calciner used for conducting the above test did not have a shrouded area at the discharge table nor did it have a flue damper to control the furnace pressure as well as the pressure within the shroud and/or soaking pit areas. A further test also carried out in a calciner comprising a rotary hearth equipped with a damper in the flue as well as a shroud at the discharge table showed fixed carbon recoveries from the materials having undergone heat treatment within the calciner to be anywhere from 97% to 108% with an average recovery of about 101%.

The aforesaid pressures in the hearth area as well as in the soaking pit or shroud areas are not to be construed as limiting but rather are set forth herein as examples only and it is set forth that these pressures may be increased or decreased depending on the nature of the materials being heat treated within the calciner enclosure.

It is possible that the calciner as well as the soaking pit and shroud areas can be operated under a negative pressure, this being possible when a calciner having a soaking pit and shroud area formed as shown in FIGS. 1 and 3 of the drawings is employed. As clearly shown in these views of the drawings a seal is formed between the shroud and soaking pit areas to thus preclude the entry of air into these portions of the calciner and the seal between the stationary roof and rotating hearth prevents the entry of air into the hearth enclosure between these parts of the calciner structure. Thus, with the damper in the flue set to a fully open position the rising flue gases will create a negative pressure within the hearth as well as in the soaking pit and/or shroud areas. Thus, the calciner may be operated under either a positive pressure or a negative pressure when some advantages in the resultant processed materials are obtained by employing either of the pressure conditions set forth above.

The above tests, only set forth herein as examples and should not be in any manner construed as limiting the invention to the pressures set forth herein. However these tests are conclusive to show that fixed carbon recoveries are increased when outside air is prevented from entering into the calciner and the soaking pit and/or shroud areas. The seals formed between the soaking pit and/or shroud areas and the discharge table together with maintaining pressures therein at above atmospheric pressure, in the manner aforesaid, precludes air infiltration into these areas of the calciner. Frequently, the material processed forms a seal in the soaking pit which isolates the furnace from the discharge table.

From the above description of the invention it will be apparent that we have improved the yield of materials undergoing a heat treatment within a rotary type calciner and the structure shown in the drawings as well as the example set forth in the specification are not to be construed as limiting the invention. Instead, the invention is to be construed as defined in the appended claims.

We claim:

1. The method of treating materials having volatiles therein which are evolved therefrom when subjected to a heat treatment within the confines of a calciner having an exhaust stack for the flow therethrough of the combustion gases created within the calciner and a soaking pit area, the improvement comprising the step of directing some of the combustion gases from the exhaust stack to combustion gas admission ports provided in the soaking pit area to provide an increase in pressure in the soaking pit area to prevent outside air from entering into and coming in contact with the materials which have been heat treated within the calciner which have been deposited into the said soaking pit area.

2. The method recited in claim 1 wherein the admission ports for the combustion gases are located in the lower portion of the said soaking pit area.

3. The method recited in claim 1 wherein the exclusion of outside air from the soaking pit area will prevent combustion of the volatiles remaining in the materials deposited therein to thus increase the yield of fixed carbon in the said volatile containing materials.

4. The method recited in claim 1 wherein the materials subjected to a heat treatment within the calciner are a combined charge of carbonaceous material and metal oxide.

5. A calciner comprising a stationary roof, sidewalls and a travelling hearth mounted therein, means for feeding volatile containing materials on said hearth and subjecting said materials to a heat treatment while on said hearth and wherein an exhaust stack for the exit of the flue gases from within the calciner extends from the roof of the calciner and is provided with a damper pivotally mounted therein and wherein a soaking pit area is provided for receiving the heat treated materials therein, the improvement comprising, adjusting the position of the said damper in said exhaust stack to restrict the outflow of some of the flue gases from within the said exhaust stack and means for directing said gases to said soaking pit area and admitting the same therein through admission ports formed in said soaking pit to thus create an increase in pressure within the said soaking pit area to prevent the entry of air into the said soaking pit area.

6. The structure recited in claim 5 wherein said soaking pit is secured to and mounted for travel within the said travelling hearth.

7. The structure recited in claim 5 wherein said soaking pit is mounted intermediate the said hearth and a discharge table extending below said soaking pit area with seals extending between said hearth and said discharge table.

8. The structure recited in claim 5 wherein a gauge is mounted in the soaking pit area to indicate the pressure in the said soaking pit area.

* * * * *